United States Patent [19]

Tredway, Sr.

[11] 4,149,726

[45] Apr. 17, 1979

[54] GOLF PRACTICE DEVICE

[76] Inventor: Wynn B. Tredway, Sr., P.O. Box 130, Freeport, Pa. 16229

[21] Appl. No.: 917,639

[22] Filed: Jun. 21, 1978

[51] Int. Cl.[2] ..... A63B 69/36

[52] U.S. Cl. ..... 273/186 E; 46/DIG. 1; 273/78

[58] Field of Search ..... 273/186 A, 186 B, 186 E, 273/173, 174, 175, 78, 193 R, 106 R, 106.5 A, 58 K; 46/DIG. 1

[56] References Cited

U.S. PATENT DOCUMENTS

| | | | |
|---|---|---|---|
| 2,175,598 | 10/1939 | Fedak | 273/79 |
| 3,721,447 | 3/1973 | Louderback | 273/186 E |
| 3,870,316 | 3/1975 | De Brocke | 273/186 E |
| 4,054,120 | 10/1977 | Foley | 273/106.5 A X |

FOREIGN PATENT DOCUMENTS

| | | | |
|---|---|---|---|
| 930255 | 7/1963 | United Kingdom | 273/199 R |

*Primary Examiner*—George J. Marlo
*Attorney, Agent, or Firm*—Sherman H. Barber

[57] ABSTRACT

A training golf club is provided with a pivotable and removable arcuate base portion mounted as a striking face of the club. Hooking VELCRO material is tautly stretched across the cavity of the base portion. Indicia are provided on the top of the head portion of such club.

A resilient elongate "ball" has an outer covering of looping VELCRO material that coacts with the hooking VELCRO material when the club is swung and the object is struck. Depending on how an indicium on the object lines up with one of the indicia on the head portion, a person swinging the training golf club knows how well his swing is.

8 Claims, 4 Drawing Figures

GOLF PRACTICE DEVICE

BRIEF SUMMARY OF THE INVENTION

The present invention relates to the game of golf and more particularly to a device, club and "ball" that can be used by beginer golfers (golf pupils) and experienced golfers as a golf practice device.

The club of the invention is a training golf club having a novel striking surface that contacts a novel "ball" that adheres to the striking surface when the training golf club is swung during a training practice session.

For a further description and understanding of the invention, reference may be made to the following detailed description and to the several figures on the drawing.

DETAILED DESCRIPTION

Figure 2:
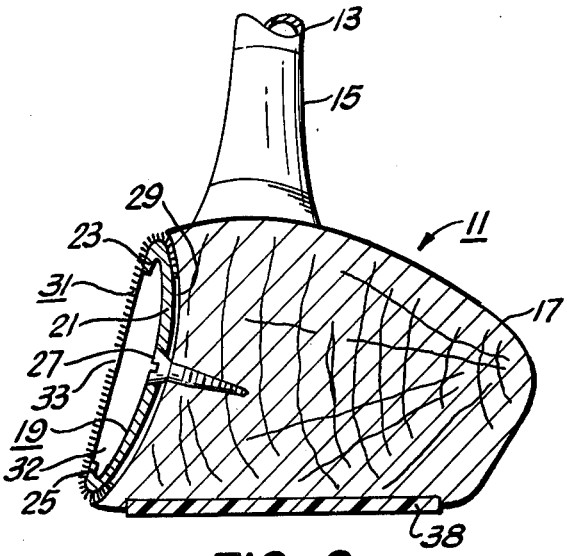
FIG. 2 is a view along line II—II of FIG. 1.
Figure 1:
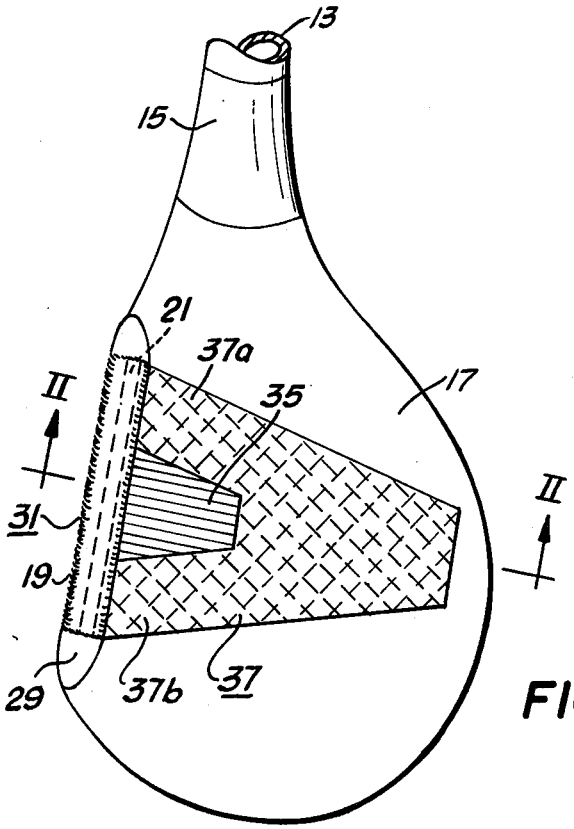
FIG. 1 is a plan view of the head portion of a training golf club in accordance with one embodiment of the invention.
Figure 4:
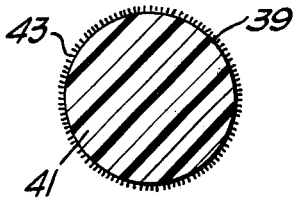
FIG. 4 is a view along line IV—IV of FIG. 3.

Referring to FIGS. 1 and 2, a training golf club 11 has a conventional shaft portion, a conventional hosel and whipping 15 that secures the shaft portion 13 to a head portion 17.

The striking face of a conventional wood golf club has a sloping face with a slight camber or bulge and there is usually an insert routed into the striking face.

The present invention comprises a club head portion 17 having a striking face that is grooved, as shown in FIGS. 1 and 2, and that accommodates an arcuate, pivotable and removable "ball"-striking device 19.

The "ball"-striking device 19 includes an arcuate rigid base portion preferably of metal 21 that has a top 23 and a bottom lands 25. The base portion 21 is removably and pivotably secured as by screw fastener 27, or by any other suitable fastner to the head portion 17. The head portion 17 is provided with a curved surface 29, as shown in FIG. 2, having the same curvature as the arcuate base portion 21.

The land portions 23, 25 support a resilient textile material 31, having hooks on the outer surface, that is stretched taut across the cavity 32 of the arcuate base portion. One suitable textile covering is marketed under the trademark VELCRO. The VELCRO material is lapped over the top 23 and bottom 25 lands and is provided with a hole 31 in the central region to permit adjustment and, if necessary, removal of the screw fastner 27. Preferably, the "ball"-striking device 19 is loosely secured to the head portion 17 so that as the training golf club 11 is swung, the device 19 tends to assume a position parallel to the floor or other horizontal surface on which the object or "ball" rests.

FIG. 1 illustrates indicia 35, 37 on the top surface of the head portion 17. Indicium 35 is in the form of a trapezoid and, for purposes of illustration in the drawing only, it is lined for blue color. Indicium 37 is a V-shaped form having leg portions 37*a* and 37*b* that surround the indicium 35, as shown. The indicium 37 is lined for orange color, but those skilled in the art will understand that the indicia may be of any color as preferred. Also, the indicia may be applied in any suitable manner as by use of a stencil and paint or by means of a decal.

As shown in FIG. 2, the conventional metal sole plate of the usual golf club head has been replaced in the present invention by a resilient sole plate 38 that may be secured to the head portion 17 in any suitable manner, as by screw fasteners or by adhesive.

Figure 3:
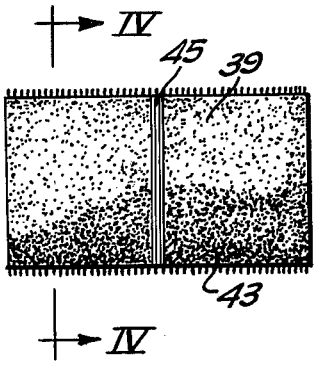
FIG. 3 is a plan view of a "ball" in accordance with one embodiment of the invention.

FIG. 3 illustrates a form of golf "ball" 39 that has an elongate cylindrical shape. The "ball" 39 is preferably a firm resilient material that is covered with VELCRO material 41. The VELCRO material 41 is looping material and it coacts with the hooking material 31 mentioned heretofore.

Encircling the "ball" where shown is an indicium 45 that is lined for red color, but other colors may be used if preferred.

When the "ball" is resting on a horizontal surface such as a floor or carpeting in a room of a house or the like, the contact engaging VELCRO material 31 would hookingly engage the looping VELCRO material 43 when the training golf club 11 is swung by a golfer or a golf pupil.

The VELCRO material 31, being stretched taut over the cavity of the arcuate base portion 21, surrounds a portion of the "ball" 39 when contact is made and the two VELCRO materials coact so that the "ball" 39 hookingly adheres to the VELCRO material 31.

When the "ball" 39 is struck properly, the indicium 45 lines up with either one of the legs 37*a* or 37*b*, or it lines up with the indicium 35. If the "ball" lines up with the indicium 35, the golfer or golf pupil knows that he has made contact correctly and that his swing is a correct swing.

Although the invention has been described herein with a certain degree of particularity, it is understood that the disclosure thereof is made only as an example and that the scope of the invention is defined by what is hereafter claimed.

What is claimed is:

1. The combination comprising:
(a) a training golf club adapted for being swung as a golf club including a head portion having an object striking face,
(b) an arcuate rigid base portion removably and adjustably mounted to said striking face,
(c) a hookingly engaging textile material supported on said arcuate base portion across the cavity thereof, and
(d) a resilient elongate object having an outer covering comprising a textile material comprised of loops that coact with said hookingly engaging textile material whereby when said training golf club is swung and contact is made with said object said object adheres to said object striking face.

2. The invention of claim 1 including:
(a) a resilient sole piece secured to the bottom portion of said head portion.

3. The invention of claim 1 including:
(a) first indicia on said head portion, and
(b) second indicium disposed on said object in such a way that, when said object is struck by said club and said second indicium is opposite one of said first indicia, said golf pupil knows how well he has swung said training golf club.

4. The invention of claim 3 wherein:
(a) said first and second indicia are colored differently.

5. The invention of claim 1 wherein:
(a) said arcuate base portion is pivotable.
6. The invention of claim 1 wherein:
(a) said striking face is grooved and accomodates said arcuate base portion.
7. The combination comprising:
(a) a training golf club adapted for being swung by a golf pupil during a training session including a shaft and a head portion having an object striking face;
(b) a groove in said object striking face disposed generally parallel to said shaft;
(c) an arcuate base portion removably and adjustably mounted in said groove to said head portion;
(d) a hookingly engaging textile material supported on said arcuate base portion across the cavity thereof;
(e) a resilient sole piece secured to the bottom of said head portion;
(f) a resilient elongate object having an outer covering comprising a textile material comprised of loops that coact with said hookingly engaging textile material whereby when said club is swung and contact is made with said object it adheres to said object striking face;
(g) first indicia on said head portion; and
(h) second indicium disposed on said object in such a way that when said object is struck by said club said second indicium is opposite one of said indicia on said head portion, said golf pupil knows how well he has swung said training golf club.
8. A training golf club including:
(a) an insert pivotably and removably mounted to the striking face of said training golf club comprising
(i) an arcuate elongate rigid base,
(ii) a hookingly engaging textile fabric tautly covering the cavity of said rigid base, and
(iii) means for pivotably and removably mounting said base to said striking face of said golf club.

* * * * *